US005695675A

United States Patent [19]

Labod

[11] Patent Number: 5,695,675

[45] Date of Patent: Dec. 9, 1997

[54] ARRANGEMENT AND METHOD FOR CONNECTION OF A STOPPER ROD FOR A METALLURGICAL VESSEL TO A LIFTING DEVICE

[76] Inventor: Burkhard Labod, Blinder Weg 14, D-46446 Emmerich, Germany

[21] Appl. No.: 583,018

[22] PCT Filed: Jul. 13, 1994

[86] PCT No.: PCT/DE94/00800

§ 371 Date: Jan. 19, 1996

§ 102(e) Date: Jan. 19, 1996

[87] PCT Pub. No.: WO95/03145

PCT Pub. Date: Feb. 2, 1995

[30] Foreign Application Priority Data

Jul. 23, 1993 [DE] Germany ..... 43 24 768.7

[51] Int. Cl.[6] ..... B22D 41/08; B22D 41/18

[52] U.S. Cl. ..... 222/602; 266/272

[58] Field of Search ..... 266/100, 271, 266/272; 222/591, 590, 602

[56] References Cited

U.S. PATENT DOCUMENTS

| | | | |
|---|---|---|---|
| 4,946,083 | 8/1990 | Fishler et al. | 222/602 |
| 5,303,905 | 4/1994 | Pohl et al. | 222/602 |

FOREIGN PATENT DOCUMENTS

| | | |
|---|---|---|
| 0358535 | 3/1990 | European Pat. Off. . |
| 0544997 | 6/1993 | European Pat. Off. . |
| 4040189 | 1/1992 | Germany . |
| 4028793 | 3/1992 | Germany . |
| 4212450 | 5/1993 | Germany . |
| 2210305 | 6/1989 | United Kingdom . |

OTHER PUBLICATIONS

International Search Report, dated 17 Nov. 1994.

International Preliminary Exam Report, dated 02 Aug. 1995.

Karl–Ernst Mayer: Stahleisen–Schriften, No. 3 "What the open hearth steel worker must known about this work", 2nd edition, Verlag Stahleisen MbH, Dusseldorf, Dec. 1963.

*Primary Examiner*—Scott Kastler

*Attorney, Agent, or Firm*—Vickers, Daniels & Young

[57] ABSTRACT

An arrangement for connecting an elongated stopper rod made of a refractory material for a metallurgical vessel to a lifting device for the stopper rod is provided. The arrangement includes a stopper rod having an upper front side and an internal longitudinal recess extending therefrom, a support having one end for engaging the lifting device an another end for engaging the stopper rod in the internal longitudinal recess. The stopper rod includes a housing that laterally widens a portion of the longitudinal recess, the housing having an upper boundary surface transverse to the longitudinal axis of the stopper rod and having side walls that taper from the upper boundary surface into the longitudinal recess. The support has at least one transverse opening in which blocking element is displaced across the longitudinal axis of the support so that the blocking element is releasably retained entirely within the cross section of the support during insertion of the support within the stopper rod in an insertion position and extends from the cross section and engages behind the upper boundary surface in a locked position. A releasable stop is provided on the support and upper front side of the stopper rod. The support can be easily and non-destructibly removed from the stopper rod and, when the stopper rod becomes worn, a new stopper rod can be mounted on the same support.

26 Claims, 3 Drawing Sheets

ARRANGEMENT AND METHOD FOR CONNECTION OF A STOPPER ROD FOR A METALLURGICAL VESSEL TO A LIFTING DEVICE

BACKGROUND OF THE INVENTION

The invention concerns an arrangement for connection of an elongated rod made of a refractory material for a metallurgical vessel to a lifting device and also encompasses a method for production of the device.

The use of refractory stopper rods to control flow of a metal melt from a kettle or tundish into a mold has long been known. For this purpose the stopper rod is moved in the direction of its longitudinal axis by a lifting device adjacent to it on the exterior of the tundish so that a discharge opening arranged on the bottom of the tundish into which the stopper rod engages and completely enters in the lowered condition is more or less opened. Flow of the metal melt is controllable on this account. This type of control in principle is quite simple, but the extreme conditions prevailing during steelmaking impose special requirements on the materials and technical design of the stopper rod. Thus, the stopper rod must withstand the effect of a metal melt for hours. The stopper rod must also be capable of withstanding the severe temperature fluctuations that act on the stopper rod during a casting process and the lateral forces caused by buoyancy of the metal melt, which exert a severe bending moment on the stopper rod. Rupture of the stopper rod undeniably leads to a situation in which the discharge can no longer be closed, which results in uncontrolled outflow of the melt. It therefore represents a significant safety risk.

In a previous known version (cf. Karl-Ernst Mayer: Stahleisen-Schriften, No. 3 "What the open hearth steel worker must know about his work", 2nd edition, Verlag Stahleisen mbH, Dusseldorf, 1963) the stopper rod consists of a steel rod threaded on one end onto which the actual ceramic stopper that engages in the discharge opening of the tundish during later use is screwed. Several ceramic stopper tubes that fully enclose the steel rod and mesh via keys and slots on their front sides above the stopper are slipped on from the side of the steel rod opposite the stopper so that the part of the stopper rod enclosed with the stopper tubes protrudes over a certain length from the melt when the stopper rod is fully lowered with the tundish filled with steel melt. The stopper rod is supported in the lifting device with the upper end of the steel rod. Since direct contact of the melt with the steel rod would lead to its immediate melting, special attention must be accorded in this stopper rod assembled from several parts (stopper, stopper tubes) to ensure that the joints between the individual parts are tight relative to penetration of steel melt. The connection sites are therefore additionally puttied. The stopper rods prepared beforehand are dried for two days at about 100° C. in a drying furnace before use.

A shortcoming in this previous variant is that preparation of the stopper rods requires relatively high material and labor expense. The steel rods also have a tendency toward warping from the temperature gradients and fluctuations that occur during casting, which can easily lead to rupture of the enclosure and thus destruction of the stopper rod. These shortcomings and the finding that nonmetallic contaminants are transported, on the one hand, by interaction with gas bubbles at the bath surface of the melt by introduction of inert gases (like argon) into the steel melt, and, on the other hand, oxide formation is reduced during the casting process, have led to the development of ceramic stopper rods produced in one piece through which the inert gas can be introduced into the steel melt at the same time. These one-piece stopper rods that are now almost exclusively used in present-day steelmaking have a central longitudinal opening that does not penetrate their lower end and connection openings that communicate from the exterior with the longitudinal opening and serve to introduce the inert gas into the steel melts.

Production of such stopper rods ordinarily occurs by isostatic pressing of a powdered ceramic material to a blank, which is then fired, i.e., subjected to temperature treatment for the purpose of sintering.

A one-part stay bar that extends over a certain region into the stopper rod from above and is rigidly connected to it, ordinarily made of steel, is used to connect the stopper rod to the lifting device and for connection of a gas feed line. A gas channel is made in the stay bar that communicates, on the one hand, with the longitudinal opening of the stopper rod and, on the other hand, with a connection device for the gas feed line. It is therefore of particular significance that no surrounding air reaches the interior of the stopper rod and thus the steel melt through the connection between the stay bar and the stopper rod, since this would lead to increased oxidation and thus a deterioration in steel quality.

The technical design of the connection between the ceramic stopper rod and the metal stay bar is particularly problematical owing to the high thermal and mechanical loads acting on the connection.

Various devices to produce the connection between a one-part stopper rod and a stay bar that account for the significance of the stopper rod with respect to safety and steel quality are already known.

In a first device known from steel production the connection is made by a ceramic threaded insert adapted to the stay bar, which can be screwed from above into the stopper rod into threading made by isostatic pressing in the upper region of the stopper rod. A shortcoming in this device is that the wall thickness of the stopper rod in the region of the inserted threading is sharply reduced so that it easily ruptures in this region. In addition, this device is relatively expensive to produce owing to the use of ceramic threaded inserts that must be produced separately.

In a second device known from DE-PS 40 40 189 C1 a transverse hole through which a pin is inserted to secure the stopper rod and passing through both parts is made in the region in which the stay bar is pushed into the stopper rod. In this arrangement both the stopper rod and the stay bar are indeed simple to produce and also easy to separate, but the entire load occurring during lifting of the stopper rod acts on the material surrounding the transverse hole so that again material ruptures often occur. Production of a gas-tight connection is also difficult.

In a third device also known from steel production a threaded hole is made in the upper end of the stopper rod by isostatic pressing by means of which the stay bar with its threading provided on the lower end is directly screwed into the stopper rod. A gas-tight connection between the stopper rod and stay bar is in principle possible with this device, but the different thermal expansion coefficients of the ceramic and steel lead to the development of stresses in the threading, which can lead to rupture of the stopper rod, especially at high temperatures.

A further development of these variants is represented by a device according to EP-0 358 535 A2. In this device a metal threaded bushing is isostatically pressed into the upper region of the longitudinal hole, which meshes with the ceramic stopper rod material on the outside via alternating all-round grooves and all-round slats. An annular sealing surface is made in the stopper rod above the threaded bushing by enlargement of the diameter of the longitudinal hole. The stay bar provided with corresponding threading can be screwed from above into the threaded bushing until a sealing collar arranged above the threading is supported on the sealing surface of the annular sealing seat. According to EP-0 358 535 A2 external threading is provided on the stay bar above the sealing collar in order to fix the stopper by means of a retaining plate and a screwed-on nut. A shortcoming in this variant is that the metal threaded bushing can easily be oxidized when burned so that screwing of the stay bar can be hampered. In addition, tightening of the lock nut, acting against the contact pressure of the sealing collar of the stay bar on the annular sealing surface of the stopper rod, especially at higher temperatures, can lead to separation of the two sealing surfaces because of the different thermal expansion coefficients of the materials. This device is also relatively costly to manufacture. Thus, the sealing collar provided on the stay bar and the threading required to screw on the lock nut require machining of the stay bar from a blank that has at least the outside diameter of the sealing collar. The material loss occurring during machining is on the order of 50%. This therefore represents a significant cost factor, since the lifetime of the stay bar is relatively short, especially because of rapid oxidization in the lower region exposed to the greatest temperature effect.

An arrangement belonging to the prior art but still not published beforehand seeks to improve these shortcomings by dividing the stay bar into a lower part that extends into the stopper rod and an upper part that can be applied to the lifting mechanism. Worn stopper rods together with the lower part of the stay bar can be easily replaced in this arrangement via a quick-coupling device with which the two parts of the stay bar can be rigidly joined gas-tight. The lower part of the stay bar having means of engagement on the end extending into the stopper rod to engage with the stopper rod material is isostatically pressed together with the stopper rod and then fired so that both parts are then joined undetachably. Although the lower part of the stopper rod is only prescribed for a single use in this fashion, material can be saved in this arrangement in comparison with the previous variants, since the lower part of the stay bar in particular is exposed to high thermal loads and thus oxidizes even after a short use time. If in previous variants the entire stay bar had to be replaced with a new one after a certain degree of oxidation had been reached in the lower region of the stay bar, then by dividing the stay bar into two parts the upper part that is more costly to manufacture can be used for a much longer time.

However, a shortcoming in this arrangement is that after common pressing of the lower part of the stay bar extending into the stopper rod and the stopper rod no means can subsequently be introduced into the longitudinal recess that are suitable to reduce backflow that develops from sudden, heat-induced gas expansion during immersion of a cold stopper rod into a metal melt or during filling of a tundish equipped with a stopper rod with a metal melt. Under practical conditions porous, ceramic inserts that are introduced into the longitudinal recess of the finished stopper rod and fill up at least part of its internal volume have proven themselves for this purpose. These inserts also avoid a situation in which metal melt is sucked into the internal volume during sudden contraction of the gas present in the internal volume, which can occur, for example, from partial cooling of the stopper rod during partial withdrawal of the stopper rod from a tundish to clear the discharge opening.

SUMMARY OF THE INVENTION

The underlying task of the invention is to further develop a generic arrangement so that, on the one hand, a worn stopper rod can be replaced by personnel with a new one with little handling and, on the other hand, the design of the stopper rod permits introduction of the inserts, whose effect has already been described, into the longitudinal recess of the stopper rod after oxidation to reduce the effects caused by changes in gas volume. This task is achieved by the invention. Because of the characteristics of the invention, installation of the stopper rod onto the stay bar designed as support tube can occur in simple fashion by inserting the support tube with the pre-installed stop into the longitudinal recess of the stopper rod and displacing a blocking element that rests in a transverse opening corresponding to the internal volume of the support tube by appropriate means so that it engages behind the upper boundary surface of a housing provided in the stopper rod. Owing to the fact that the side walls of the housing are bent downward or taper into the longitudinal recess the blocking element can be pushed back into the cross section of the support to disassemble the stopper rod so that the support is pushed back slightly into the stopper rod after loosening of the stop. After this displacement the stopper rod can be withdrawn downward from the support.

To better distribute the retaining forces exerted on the stopper rod by the blocking element it is advantageous if the housing is provided in the internal volume with a press-fit sleeve that is pressed into it during isostatic pressing of the stopper rod.

The press-fit sleeve is simple and cost-effective to manufacture if it consists of a rotationally symmetric turned part.

In order to distribute the retaining forces over a larger surface of the stopper rod material and thus reduce the material load it can be advantageous to provide the press-fit sleeve with at least one outer all-round groove.

This expedient can simultaneously serve to accept a heat-resistant sealing ring, if special requirements make particularly good sealing necessary between the press-fit sleeve and the stopper rod.

A correspondingly better sealing effect between the press-fit sleeve and the support can be achieved in that the press-fit sleeve in its region forming part of the longitudinal recess has at least one internal all-round groove in which a heat-resistant sealing ring rests. However, it is also possible to provide at least one outer peripheral groove on the support in its region extending into the stopper rod, which carries a heat-resistant sealing ring that cooperates with the side wall of the longitudinal recess of the stopper rod.

In applications in which no special sealing effect is required overall between the support and the stopper rod a sufficient distribution of retaining forces can also occur in simple and cost-effective fashion by forming the upper boundary surface by a support ring pressed into the stopper rod during its manufacture.

In order to be able to avoid spontaneous displacement of the blocking element by the effect of, say, vibrations, when the stopper rod is installed, it is advantageous to equip the upper boundary surface with an undercut that cooperates with a protrusion on the blocking element.

The support is particularly suited for connection of the gas feed and installation in the stopper rod if it has a central longitudinal hole.

The transverse opening then advantageously consists of a radial hole arranged perpendicular to the longitudinal axis of the support and communicating with its longitudinal hole.

A cylindrical pin whose length corresponds roughly to half the outside diameter of the support advantageously serves as blocking element in this variant. In the inserted state, i.e., in the "unlocked" position, the pin thus extends roughly to the longitudinal axis of the support in its longitudinal hole. The "locked" position of the pin can advantageously be chosen so that it corresponds to displacement of the pin into a position that blocks off the longitudinal hole with the inside periphery. Securing of the pin in the "locked" position can then occur in simple fashion by providing a cross-sectional narrowing that reduces the diameter of the longitudinal hole on the lower end of the support, on which a retaining sleeve introduced into the longitudinal hole of the support from above is supported and covers the radial hole.

Another preferred variant of the blocking element is in which the retaining sleeve can be dispensed with, as well as the design of the transverse opening required to accept this blocking element.

It is particularly advantageous if the stop is formed by a nut screwed onto an outside threading of the support extending upward from the front surface of the stopper rod and supported against the front surface by means of a pressure disk. With this arrangement, on the one hand, the position of the stop can be individually adjusted to tolerances in position of the upper boundary surface of the housing and, on the other hand, fixed locking of the stopper rod installed in the support is possible in simple fashion.

Experiments have shown that it is particularly favorable to produce the press-fit sleeve or the support ring from a metal material. Depending on the application, low-alloy steels or also special steels are considered here, the latter especially when the press-fit sleeve or support ring is to be used repeatedly.

Displacement of the blocking element from the "unlocked" position to the "locked" position can advantageously occur by means of an auxiliary installation rod that can be introduced into the longitudinal hole of the support, whose introduction end tapers to a peak and is therefore suitable for displacing the blocking element outward by its length extending into the longitudinal hole in the "unlocked" position.

A particularly suitable method for production of a device in accordance with the invention is also disclosed. In this case a secure, unloosenable and essentially tight seat of the press-fit sleeve or support ring is achieved in the stopper rod in that the press-fit sleeve or the support ring is pressed during isostatic pressing of the stopper rod and then fired together with the stopper rod.

The housing required beneath the support ring can advantageously be created in the stopper rod by pressing a spacer sleeve beneath the support ring during isostatic pressing, which consists of a compression-proof material, like plastic or the like, that evaporates and/or burns up during subsequent firing.

In order to avoid excess stresses between the pressed parts and the stopper rod, especially at high temperatures, it is advantageous if the press-fit sleeve of the support ring be coated with a material that evaporates during firing before common isostatic pressing.

To save material and thus costs it is particularly advantageous if the threading arranged on the support is produced without cutting.

Practical examples of the invention are schematically depicted in the drawing.

Figure 1:
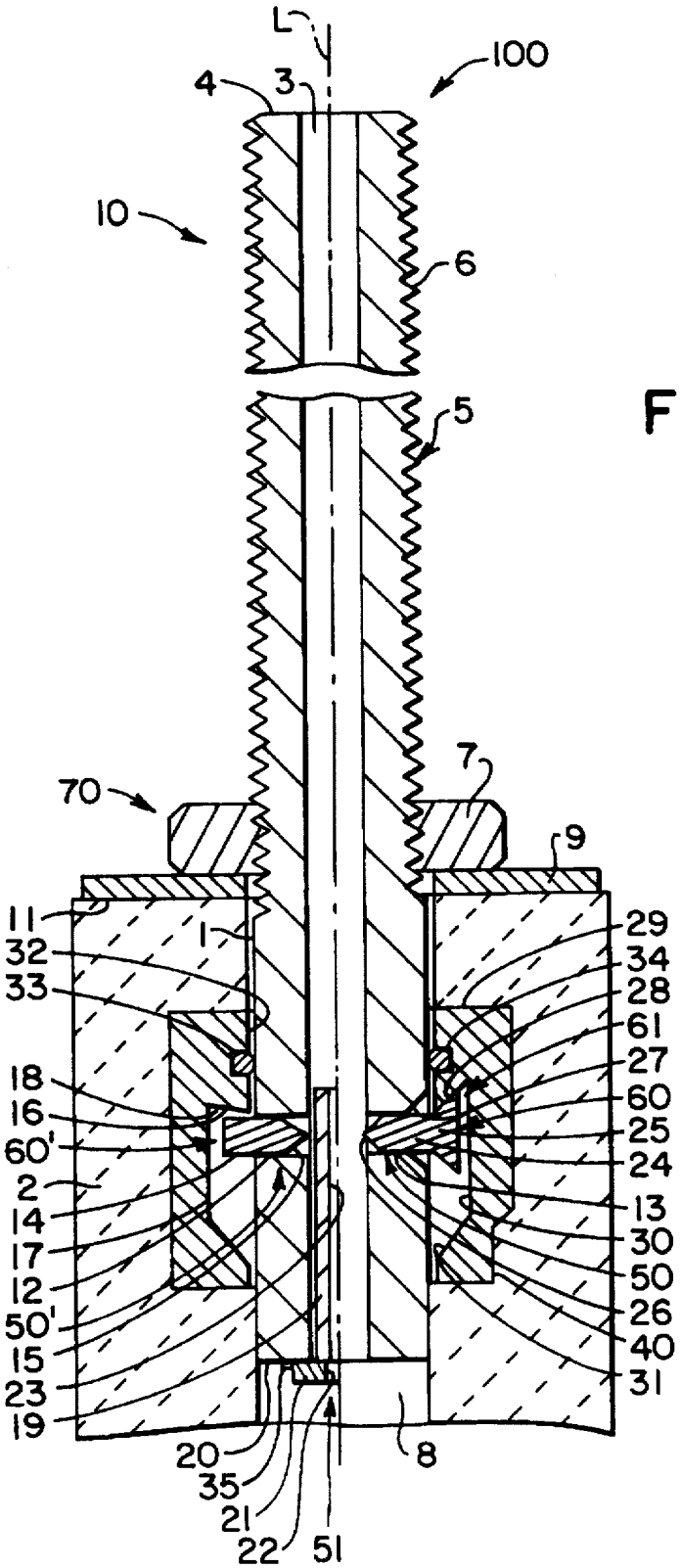
FIG. 1 shows a longitudinal section through a first variant of the device according to the invention.
Figure 2:
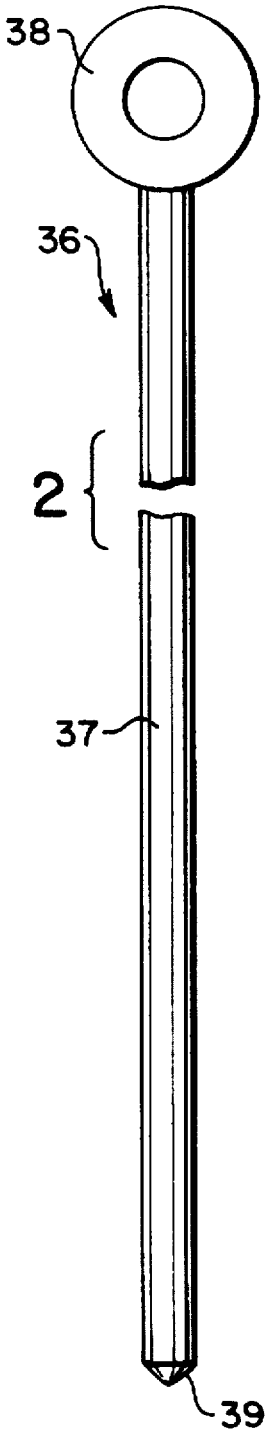
FIG. 2 shows an auxiliary installation rod.
Figure 3:
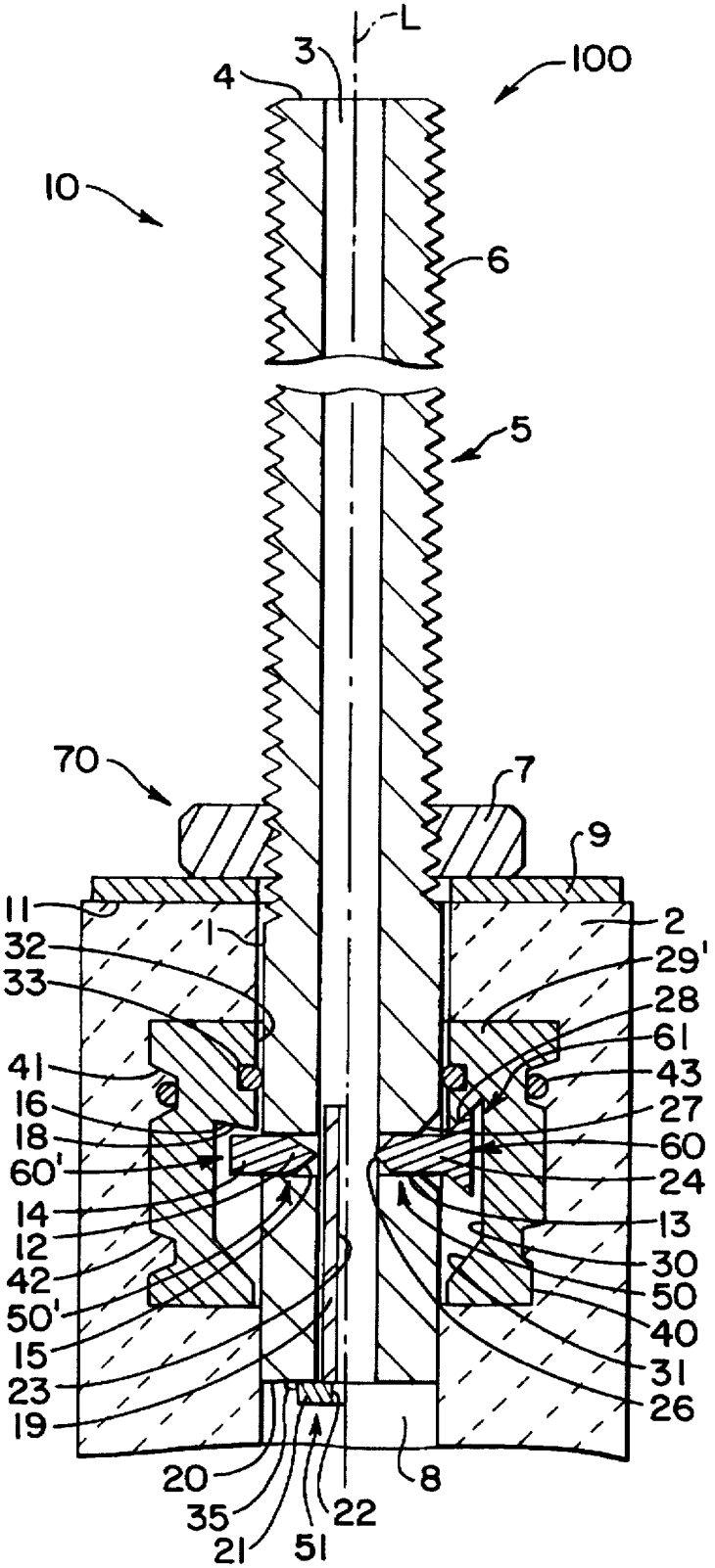
FIG. 3 shows a longitudinal section through a second variant of the device according to the invention.
Figure 4:
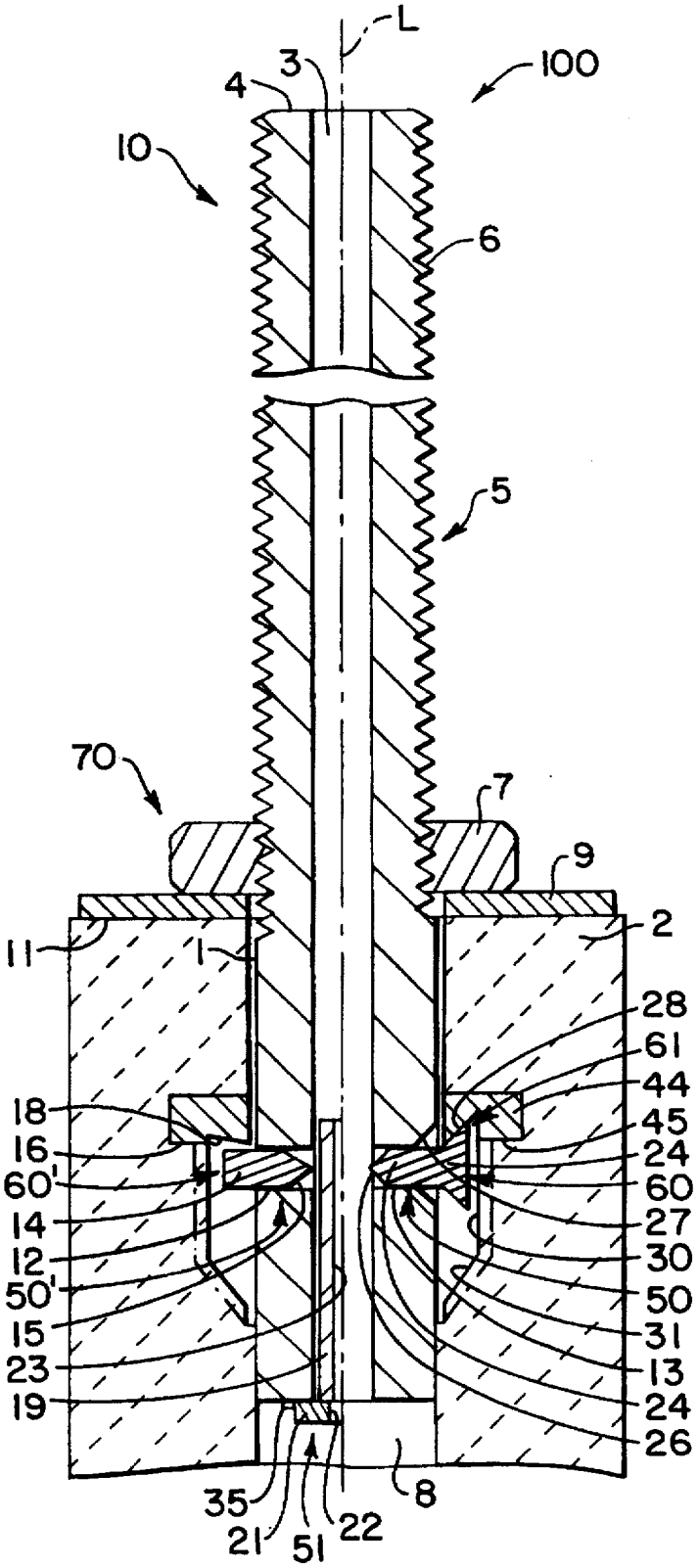
FIG. 4 shows a longitudinal section through a third variant of the device according to the invention.
Figure 5:
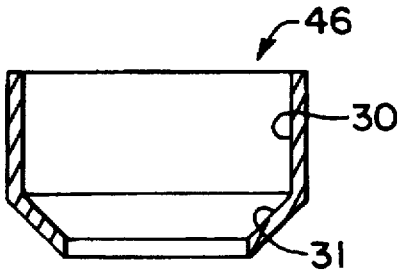
FIG. 5 shows a longitudinal section through a contour insert consisting of a metal molded article, by means of which the housing can be formed in the variant according to FIG. 4
Figure 6:
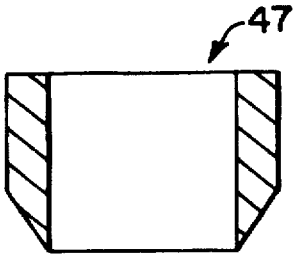
FIG. 6 shows a longitudinal section through a spacer sleeve, by means of which the housing can be formed in the variant according to FIG. 4.

When "top" or "bottom" are spoken of below the suspended operating position of the arrangement depicted in FIGS. 1, 2 and 4 is referred to. In these figures two different variants of the blocking element are shown on both sides of the longitudinal axis of the arrangement that ordinarily finds application alternatively. However, in principle it is also possible to use both variants together in an arrangement according to the invention. The arrangement denoted 100 in the drawing as a whole consists of an elongated metal support 10 that extends with its lower region 1 into a longitudinal recess 8 in a refractory, ceramic stopper rod 2. The support 10 has a central longitudinal hole 3 extending over its entire length, whose diameter is about 30% of the outside diameter of support 10. On its outside periphery 5 the support 10 has outside threading 6 extending from its upper end 4 to its lower region 1, which, on the one hand, serves to accept a nut 7 and, on the other hand, serves for attachment of the support 10 to a lifting device not shown in the drawing. The nut 7 forming a stop 70 borders the lower region 1 of support 10 that can be introduced into the longitudinal recess 18 of stopper rod 2 and is supported by means of a pressure disk 9 on the upper front side 11 of stopper rod 2. Two radial holes 12, 13 running perpendicular to the longitudinal axis L of the arrangement are incorporated in support 10 roughly in the center of the lower region 1 of support 10. The holes 12, 13 form transverse openings 50, 50' and serve to accept blocking elements 60, 60' that can be displaced perpendicular to longitudinal axis L and serve to lock support 10 in stopper rod 2. Different variants of the blocking elements 60, 60' are shown in FIGS. 1, 3 and 4 on both sides of longitudinal axis L. In the variant shown on the left side the blocking element 60' consists of a cylindrical pin 14 that rests in hole 12 and forms a sliding fit with it. The end of pin 14 having a length of about half the outside diameter of support 10 facing longitudinal hole 3 is formed as a rigid cone 15 that tapers to a peak. In the "unlocked" position the pin 14 remains entirely in the cross section of support 10 and extends roughly from the outer opening of hole 12 to longitudinal axis L of the arrangement so that the lower region 1 of support 10 can be pushed into the longitudinal recess 8 of stopper rod 2. In the "locked" position the pin 14 protrudes from the cross section by roughly half the diameter of longitudinal hole 3 and engages behind an upper boundary surface 16 (aligned perpendicular to longitudinal axis L of the arrangement) of a housing 17 that widens longitudinal recess 8 and is provided within stopper rod 2. In this fashion the support 10 cannot be withdrawn upward from stopper rod 2 in this position of pin 14. In order to prevent inward directed force components from acting radially on pin 14 owing to its support of upper boundary surface 16, which would displace pin 14 from the "locked" position into the "unlocked" position, the upper boundary surface 16 is provided with an undercut 18. A retaining sleeve 19 that is supported on a cross-sectional narrowing 51 provided on the lower end 20 of support 10 and can be inserted into longitudinal hole 3 serves for further retention of pin 14 in its "locked" position. The cross-sectional narrowing 51 is formed by means of a perforated disk 21 applied to the lower end 20 of support 10, whose hole diameter 22 corresponds roughly to the inside diameter 23 of the retaining sleeve. The perforated disk is secured on support 10 by spot welding 35, which, if necessary, can be loosened by an external force, for example, by a hammer blow. The retaining sleeve 19 extends from perforated disk 21 into longitudinal hole 3 upward far enough so that it covers hole 12 with its external periphery so that pin 14 cannot be displaced from its "locked" position.

In the practical example of blocking element 60 depicted in FIGS. 1, 3 and 4 on the right side of longitudinal axis L it consists of a pin 24 that carries a countersunk expansion 25 on its outward directed end. The total length of pin 24 corresponding to pin 14 amounts to about half the diameter of support 10 and the side of pin 24 facing longitudinal hole 3 also ends in a steep cone 26 that tapers to a peak. In the "unlocked" position the pin 24 forming a sliding fit with hole 13 is completely pushed into support 10 so that the countersunk expansion 25 rests in a countersunk bezel 27 made in support 10 from the outside. In the "locked" condition the pin 24 is in a position in which it protrudes from the support over roughly the thickness of the countersunk expansion 25. The protruding, oblique ring surface 28 of countersunk expansion 25 cooperates with the undercut 18 of the upper boundary surface 16 of housing 17 so that the pin 24 cannot be spontaneously displaced from its "locked" position.

Displacement of pin 14, 24 from the "unlocked" position to the "locked" position after insertion of the lower part 1 of support 10 is served by an auxiliary installation rod 36 shown in FIG. 2 that can be introduced from the top into longitudinal hole 3 of support 10. The auxiliary installation rod 36 consists of an elongated round rod 37 that includes a handle 38 on its upper end. Its lower end forms a cone 39 that tapers to a peak, which cooperates on insertion with the cones 15, 26 of the pins 14, 24 situated in the cross section of the support 10 and displaces these outward. The pins 14, 24 engage behind the upper boundary surface 16 in this "locked" position so that the support 10 can no longer be withdrawn from stopper rod 2. By subsequent tightening of nut 7 against the upper front side 11 of stopper rod 2 the support 10 can be locked so that a fixed sealing is guaranteed. For additional sealing a packing not shown in the drawing can be inserted into the threads covered by the nut 7.

The rotationally symmetric housing 17 is incorporated in a press-fit sleeve 29 in the variant according to FIG. 1, which consists of a turned part produced from a metallic material. The housing 17 has a cylindrical region 30 extending downward from the upper boundary surface 16, on which a flatly conical region 31 is connected that grades into longitudinal recess 8. By this embodiment of housing 17 the pins 14, 24 (optionally after removal of retaining sleeve 19) can be displaced from the "locked" position into the "unlocked" position so that the support is pushed further into the longitudinal recess 8 of stopper rod 2 and the pins 14, 24 are pushed through the side walls of the flatly conical regions 31 of the housing 17 into the cross section of support 10. After this process the support 2 can be withdrawn upward from the stopper rod.

In its region 32 above the upper boundary surface of the housing the press-fit sleeve forms a part of the longitudinal recess 8. In this region 32 an inner all-round groove 33 is made in the press-fit sleeve 29 that serves to accept a heat-resistant sealing ring 34. The high sealing effect between the press-fit sleeve 29 and the support 10 necessary in special applications can be achieved by sealing ring 34.

In the practical example of the arrangement 100 depicted in FIG. 1 the press-fit sleeve 29 has a cylindrical outer shape. A flat key surface 40 milled into its outer periphery serves for locking in stopper rod 2. Since the press-fit sleeve 29 is pressed isostatically together with stopper rod 2, its external periphery is completely surrounded by the ceramic stopper rod material.

In the practical example according to FIG. 3 two all-round grooves 41, 42 vertically spaced from each other are additionally incorporated in the external periphery of press-fit sleeve 29'. By this embodiment of the press-fit sleeve 29' additional joining surfaces are created between press-fit sleeve 29' and stopper rod 2 so that the surface load acting overall on the stopper rod material is reduced in comparison with the variant according to FIG. 1. This variant is also particularly suited for applications in which especially good sealing is required between support 10 and the stopper rod 2, since, for example, a heat-resistant sealing ring 43, as shown in FIG. 3, can be inserted into the upper all-round groove 41.

If a particularly good sealing effect can be dispensed with, the cost-effective embodiment of the arrangement according to the invention according to FIG. 4 recommends itself. In this variant only a support ring 44 is isostatically pressed into the stopper rod 2 in order to distribute the retaining forces applied by support 10 to the stopper rod material, the lower side 45 of which forms the upper boundary surface 16, which again has an undercut 18. Locking of the support ring 44 in the stopper rod 2 can again be achieved by a flat key surface not shown in the drawing. In this variant the housing 17 can be formed in two different ways. On the one hand, a contour insert 46 consisting of a metal molded article whose internal volume has the described shape of housing 17 can be isostatically pressed beneath support ring 44. On the other hand, it is possible during isostatic pressing to isostatically press in a pressure-resistant spacer sleeve 47 beneath support ring 44, whose outer contour corresponds to the "negative" of the described shape of the housing 17, i.e. which forms the housing 17 directly in the stopper rod material during isostatic pressing. This type of spacer sleeve 47 consists of a material, for example, compression-proof plastic or the like, that evaporates and/or burns up during subsequent heat treatment of the stopper rod, so-called "firing".

Having thus described the invention, it is claimed:

1. Arrangement for connection of an elongated stopper rod made of a refractory material for a metallurgical vessel to a lifting device for the stopper rod, comprising a stopper rod having an upper front side and an internal longitudinal recess extending therefrom, a support having one end for engaging the lifting device and another end for engaging said stopper rod in said internal longitudinal recess, the stopper rod including a housing that laterally widens a portion of the longitudinal recess, said housing having an upper boundary surface transverse to the longitudinal axis of said stopper rod and having side walls that taper from said upper boundary surface, into said longitudinal recess, the support having at least one transverse opening in which a blocking element is displaced across the longitudinal axis of the support so that said blocking element; is releasably retained entirely within the cross section of the support during insertion of said support within said stopper rod in an insertion position and extends from the cross section and engages behind the upper boundary surface in a locked position and a releasable stop is provided on said support and is supported against the upper front side of said stopper rod.

2. Arrangement according to claim 1, wherein said stopper rod includes a press-fit sleeve rigidly connected thereto, said sleeve having an internal volume forming said housing and a part of the longitudinal recess above said housing.

3. Arrangement according to claim 2, wherein said press-fit sleeve comprises a rotationally symmetric turned part.

4. Arrangement according to claim 2, wherein said press-fit sleeve includes at least one outer circumferential groove.

5. Arrangement according to claim 4, wherein a heat-resistant sealing ring is inserted into at least one circumferential groove.

6. Arrangement according to claim 2, wherein said press-fit sleeve has at least one internal circumferential groove forming a part of the longitudinal recess, a heat-resistant sealing ring resting therein.

7. Arrangement according to claim 1, wherein said upper boundary surface is formed by a support ring pressed into the stopper rod during its manufacture.

8. Arrangement according to claim 1, wherein said upper boundary surface has an undercut and said blocking element has a mating protrusion, said undercut cooperating with said protrusion on the blocking element.

9. Arrangement according to claim 1, wherein said support has a central longitudinal hole.

10. Arrangement according to claim 9, wherein said transverse opening comprises a radial hole that is arranged perpendicular to the longitudinal axis of said support and communicates with said longitudinal hole.

11. Arrangement according to claim 10, wherein said blocking element comprises a cylindrical pin having a length corresponding to about half the outside diameter of said support.

12. Arrangement according to claim 9, including a cross-sectional narrowing piece that reduces the diameter of said longitudinal hole is provided on the lower end of said support.

13. Arrangement according to claim 12, said cross-sectional narrowing piece is a retaining sleeve that is introduced into the longitudinal hole of said support and covers the radial hole.

14. Arrangement according to claim 9, wherein said support includes an outside wall transverse opening said transverse opening comprising a radial hole arranged perpendicular to the longitudinal axis of the support, said radial hole communicating with said longitudinal hole and including a countersunk bezel on the outside wall of said support.

15. Arrangement according to claim 14, wherein said blocking element comprises a pin having an outward directed end that is radially expanded in a countersunk fashion.

16. Arrangement according to claim 9, wherein said end of said blocking element facing the inside volume of said support tapers to a peak.

17. Arrangement according to claim 1, wherein said stop is formed from a nut screwed onto an outside threading of said support extending upward from the upper from side of stopper rod and a pressure disk is disposed between said nut and the upper front side.

18. Arrangement according to claim 2, wherein said press-fit sleeve is made from a metal material.

19. Arrangement according to claim 9, including an auxiliary installation rod for displacement of said blocking element to said locked position, said installation rod introduced into the longitudinal hole of said support said installation rod including an introduction end that tapers to a peak, said introduction end for acting on the side of blocking element facing the longitudinal hole and forcing said blocking element out from the cross section of said support.

20. Process for producing the arrangement according to claim 2, including pressing said press-fit sleeve into said stopper rod during isostatic pressing of the stopper rod and after isostatic pressing firing said sleeve and said stopper rod together.

21. Process according to claim 20, including providing a spacer sleeve comprising a compression-proof material which evaporates and burns up during firing and pressing said spacer sleeve within said press-fit sleeve during isostatic pressing with the stopper rod.

22. Process according to claim 20, including coating said press-fit sleeve with a material that evaporates during firing before isostatic pressing with said stopper rod.

23. Arrangement for non-destructively connecting and disconnecting an elongated stopper rod made of a refractory material for a metallurgical vessel to a lifting device for the stopper rod, comprising a stopper rod having an upper front side and an internal longitudinal recess extending therefrom, a support having one end for engaging the lifting device and another end for engaging said stopper rod in said internal longitudinal recess, the stopper rod including a housing that laterally widens a portion of the longitudinal recess, said housing having an upper boundary surface transverse to the longitudinal axis of said stopper rod and having side walls that taper into said longitudinal recess, the support having at least one transverse opening in which a blocking element is displaced across the longitudinal axis of the support so that said blocking element is releasably retained within the cross section of the support during insertion of said support within said stopper rod in an insertion position and extends from the cross section and engages behind the upper boundary surface in a locked position and a releasable stop is provided on said support and is supported against the upper front side of said stopper rod.

24. The an arrangement of claim 23, including means for maintaining said blocking element in said locked position, said maintaining means covering said transverse opening in said locked position.

25. The arrangement of claim 23, including a sleeve extending longitudinally within said support and covering said transverse opening in said locked position.

26. Arrangement for locking and unlocking an elongated stopper rod for a metallurgical vessel to a support comprising a longitudinally extending internal recess within said stopper rod for receipt of said support within which said stopper rod is to be locked; at least one blocking element in sliding engagement with said support, said recess including, at a position intermediate the longitudinal dimension thereof, an annular conical outwardly enlarged portion defining a stop surface to confront ends of said blocking elements which slide radially outwardly from said support resulting in said stopper rod being locked onto said support; and said blocking element including means for sliding said element within said support for non-destructively retracting said support from said stopper rod to disconnect said support from said stopper rod.

* * * * *